US006843071B1

(12) United States Patent
Sabin et al.

(10) Patent No.: US 6,843,071 B1
(45) Date of Patent: Jan. 18, 2005

(54) PREPARATION OF REFRIGERANT MATERIALS

(75) Inventors: Cullen M. Sabin, Bradenton Beach, FL (US); Zbigniew R. Paul, Sarasota, FL (US); Martin W. Sabin, Sarasota, FL (US)

(73) Assignee: Tempra Technology Inc., Bradenton, FL (US)

( * ) Notice: Subject to any disclaimer, the term of this patent is extended or adjusted under 35 U.S.C. 154(b) by 0 days.

(21) Appl. No.: 10/169,307

(22) PCT Filed: Feb. 24, 2000

(86) PCT No.: PCT/US00/04634

§ 371 (c)(1),
(2), (4) Date: Jan. 21, 2003

(87) PCT Pub. No.: WO00/50823

PCT Pub. Date: Aug. 31, 2000

Related U.S. Application Data

(60) Provisional application No. 60/121,761, filed on Feb. 26, 1999.

(51) Int. Cl.[7] ..... F25B 17/08

(52) U.S. Cl. ..... 62/480; 62/101

(58) Field of Search ..... 62/101, 476, 480, 62/490, 298; 165/104.12

(56) References Cited

U.S. PATENT DOCUMENTS 3,975,350 A 8/1976 Hudgin et al.
4,161,210 A * 7/1979 Reid et al. ..... 165/104.12
4,178,271 A 12/1979 Busch et al.
4,205,531 A * 6/1980 Brunberg et al. ..... 62/101
4,248,607 A 2/1981 Folkers
4,250,720 A * 2/1981 Siegel ..... 62/480
4,423,099 A 12/1983 Mueller et al.
4,526,887 A 7/1985 Sutt, Jr.
4,548,046 A 10/1985 Brandon et al.
4,650,621 A 3/1987 Sago et al.
4,668,551 A 5/1987 Kawasaki et al.
4,802,343 A * 2/1989 Rudick et al. ..... 62/294
4,920,172 A 4/1990 Daoud
4,949,549 A 8/1990 Steidl et al.
5,087,778 A 2/1992 Yates
5,139,841 A 8/1992 Makoui et al.
5,168,708 A 12/1992 Siegel
5,186,020 A 2/1993 Rockenfeller et al.
5,503,222 A 4/1996 Dunne
5,535,817 A 7/1996 Dunne
5,598,721 A 2/1997 Rockenfeller et al.
5,688,855 A 11/1997 Stoy et al.
5,741,749 A 4/1998 Crocco et al.
5,741,828 A 4/1998 Stoy et al.
5,776,273 A 7/1998 Takeuchi et al.
5,802,870 A 9/1998 Arnold et al.
5,817,713 A 10/1998 Pappas et al.
5,855,724 A 1/1999 Schilf

* cited by examiner

*Primary Examiner*—Melvin Jones
(74) *Attorney, Agent, or Firm*—Fish & Richardson P.C.

(57) ABSTRACT

Portable refrigeration devices (1) including methods for preparing sorbents (30) for use in such devices, and the sorbents (30) prepared in this way. The methods relate to the substantially complete degassing for the maximization of receiving refrigerant vapor from the evaporator chamber (10) of such refrigeration devices (1), and the maximization of heat transfer to heat sink materials (40) in such refrigeration devices (1).

19 Claims, 3 Drawing Sheets

PREPARATION OF REFRIGERANT MATERIALS

This application claims the benefit of provisional application No. 60/121,761, filed Feb. 26, 1999.

BACKGROUND OF THE INVENTION

The invention relates to self-refrigerating devices employing evaporation/condensation processes. Specifically the invention relates to methods for the preparation of sorbent materials useful in such devices, and the sorbent materials resulting from these preparation methods.

Self-refrigerating devices are known in the art. These devices are designed to provide cooling without resort to external sources of cooling such as electricity, ice and the like. These devices can also be designed to be highly portable. Conveniently, they are designed to deliver cooling on a single-use basis, and are therefore disposable.

Many products, including liquid products, have more favorable properties when cold than when at ambient temperatures. Thus, cooling of these products to temperatures of between about 0° C. and 20° C. is desirable. Generally, such cooling is carried out by electrically-powered refrigeration units, or by means of a phase change material such as ice. The use of these units to cool such foods and beverages is not always practical because refrigerators generally require a source of electricity, they are not usually portable, and they do not cool the food or beverage quickly.

An alternate method for providing a cooled material on demand is to use portable insulated containers. However, these containers function merely to maintain the previous temperature of the food or beverage placed inside them, or they require the use of ice cubes to provide the desired cooling effect When used in conjunction with ice, insulated containers are much more bulky and heavy than the food or beverage. Moreover, in many locations, ice may not he readily available when the cooling action is required.

Ice cubes have also been used independently to cool food or beverages rapidly. However, use of ice independently for cooling is often undesirable because ice may be stored only for limited periods above 0° C. Moreover, ice may not be available when the cooling action is desired.

In addition to food and beverage cooling, there are a number of other applications for which a portable cooling device is extremely desirable. These include medical applications, including cooling of tissues or organs; preparation of cold compresses and cryogenic destruction of tissues as part of surgical procedures; industrial applications, including production of cold water or other liquids upon demand; preservation of biological specimens; cooling of protective clothing; and cosmetic applications. A portable cooling apparatus could have widespread utility in all these areas.

Most attempts to build a self-contained miniaturized cooling device have depended on the use of a refrigerant liquid stored at a pressure above atmospheric pressure, so that the refrigerant vapor could be released directly to the atmosphere. Unfortunately, many available refrigerant liquids for such a system are either flammable, toxic, harmful to the environment, or exist in liquid form at such high pressures that they represent an explosion hazard in quantities suitable for the intended purpose. Conversely, other available refrigerant liquids acceptable for discharge into the atmosphere (such as carbon dioxide) have relatively low heat capacities and latent heats of vaporization. As a result, some cooling devices which release carbon dioxide are more bulky than is commercially acceptable for a portable device.

An alternate procedure for providing a cooling effect in a portable device is to absorb or adsorb the refrigerant vapor in a chamber separate from the chamber in which the evaporation takes place. In such a system, the refrigerant liquid boils under reduced pressure in a sealed chamber and absorbs heat from its surroundings. The vapor generated from the boiling liquid is continuously removed from the first chamber and discharged into a second chamber containing a desiccant or sorbent that absorbs the vapor.

SUMMARY OF THE INVENTION

The invention provides methods for the preparation of sorbent materials used in evaporation/condensation-type self-refrigerating devices, and sorbent materials which are produced with these methods. The invention is born out of the requirement for high efficiency vapor absorption, and high efficiency heat transfer to a heat sink material.

In one aspect, the invention provides a method for preparing a sorption chamber for a portable, single-use, non-releasing evaporation-type refrigerator that produces a refrigerant vapor, such as water vapor, during evaporative heating. The method includes providing a sealable chamber and a sorbent material (such as a zeolite molecular sieve) for absorbing and adsorbing refrigerant vapor. The method also involves heating the sorbent material to a temperature high enough (for example, at least about 250° C. or even 350° C.) to volatilize certain absorbed and adsorbed material on and in the sorbent, like water. The volatilized material is removed from the heated sorbent material by evacuating said sorbent material, for example to a pressure of not more than about 15 milliTorr, and, in some embodiments, a backfilling gas is added to the sorbent. The gas has a ratio of specific heats of at least about 1.5, or up to 1.6. This can include gases such as helium, neon, argon, krypton and xenon. The sorbent chamber can be loaded with the sorbent charged with the backfilling gas, to pressures of for example, 350 Torr to about 2000 Torr. This gas can be added while the sorbent is still hot, such as at least 100° C. or from about 25° C. to about 200° C. The backfilling gas is removed from the sorbent by evacuating the sorbent chamber, for example by re-evacuation of said sorbent chamber to a pressure of less than about 15 milliTorr. The sorbent chamber is then sealed to prevent introduction of air gases to the sorbent. The sorbent chamber can be in thermal contact with a phase change-type heat sink material having a phase transition temperature. The sealable chamber for sorbent can be provided as flushed and filled with a flushing gas with a ratio of specific heats which can be the same as or different than the backfilling gas. Alternately, the sealable chamber for sorbent can be provided as an evacuated chamber, evacuated to a pressure of not more than about 15 milliTorr. The sorbent need not be backfilled with a gas, but can be loaded directly into the sorber tinder a vacuum, without heating.

In another aspect, the invention provides a sorbtion chamber prepared according to the methods described above.

In another aspect, the invention provides a method of cooling a product, such as an aqueous liquid, including a beverage, with a portable, single-use, non-releasing evaporation-type refrigerator that produces refrigerant vapor, such as water during evaporative heating. The method includes providing a refrigerator as described herein, having a sorption chamber described as above and prepared according to the methods described above. The method also includes operating means for preventing refrigerant vapor flow (such as, for example, a pressure sensitive valve and an actuator), thereby permitting the flow of refrigerant vapor.

Accordingly, the pressure in the evaporator chamber is reduced, causing the refrigerant to vaporize and form a refrigerant vapor, the vapor is collected by the sorbent material in the sorber, and heat is generated in the sorbent. The vapor is removed from the evaporator chamber by collecting the vapor in the sorbent until an equilibrium is reached, so that the sorbent is substantially saturated or substantially all the refrigerant has been collected in the sorbent material. The heat generated in the sorbent within the sorber is to be contained by means of the phase change-type heat sink in material.

The invention provides a self-contained and disposable refrigeration device. The device according to the invention does not vent a gas or vapor of any kind. There are no hazardous or toxic materials or components included in the device, and recycling of the materials of the device is facilitated. There are no pressurized eases present in the device and no environmentally objectionable materials such as unstable refrigerants. The device does not explode, even when consumed by fire, and is not flammable.

As used herein, the term "sorption" refers to both adsorption and absorption. The term "adsorption" refers to a type of molecular adhesion which takes place at the surface of a solid or a liquid in contact with another medium, and resulting in an accumulation or increased concentration of molecules from that medium in the immediate vicinity of the surface. Such adsorption includes polar adsorption of ionic species (which are generally not removed from surfaces by heating and evacuation), specific adsorption, chemical adsorption, van der Waals adsorption, and occlusion (incorporation of gas in crystal structure of solid, which is generally not removed by heating and evacuation). The term "absorption" refers to the penetration of one substance into the inner structure of another, and includes non-reactive absorption. Reactive absorption, by which is meant absorption processes accompanied by chemical reaction, is not included in the definition as used in this application, unless specifically included. These particular definitions are found, and given in more detail in such publications as Van Nostrand's Scientific Encyclopedia $5^{th}$ ed., Van Nostrand Reinhold Company, New York (1976) and The Encyclopedia of Chemistry, $3^{rd}$ ed., Van Nostrand Reinhold Company, New York (1973).

Unless otherwise defined, all technical and scientific terns used herein have the same meaning as commonly understood by one of ordinary skill in the ah to which this invention belongs. Although methods and materials similar or equivalent to those described herein can be used in the practice of the present invention, suitable methods and materials are described below. All publications, patent applications, patents, and other references mentioned herein are incorporated by reference in their entirety. In ease of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION OF THE INVENTION

The self-refrigerating device used in the present invention includes three basic sections: an evaporator chamber containing a refrigerant, an evacuated sorbent chamber containing a sorbent and a heat sink material, and a means to prevent the flow of refrigerant vapor between the evaporator chamber and the sorbent chamber. This flow-preventing means is also adapted to allow the flow of refrigerant vapor between the evaporator and sorbent chambers, such as when the device is in operation. The functional relationships between these sections in a particular refrigeration device have been roughly described in U.S. Pat. Nos. 5,197,302 and 5,048,301. The inventive devices are generally utilized in conjunction with a product to be cooled. These products and associated uses will be detailed after discussion of the device itself, which follows directly below.

Figure 1:
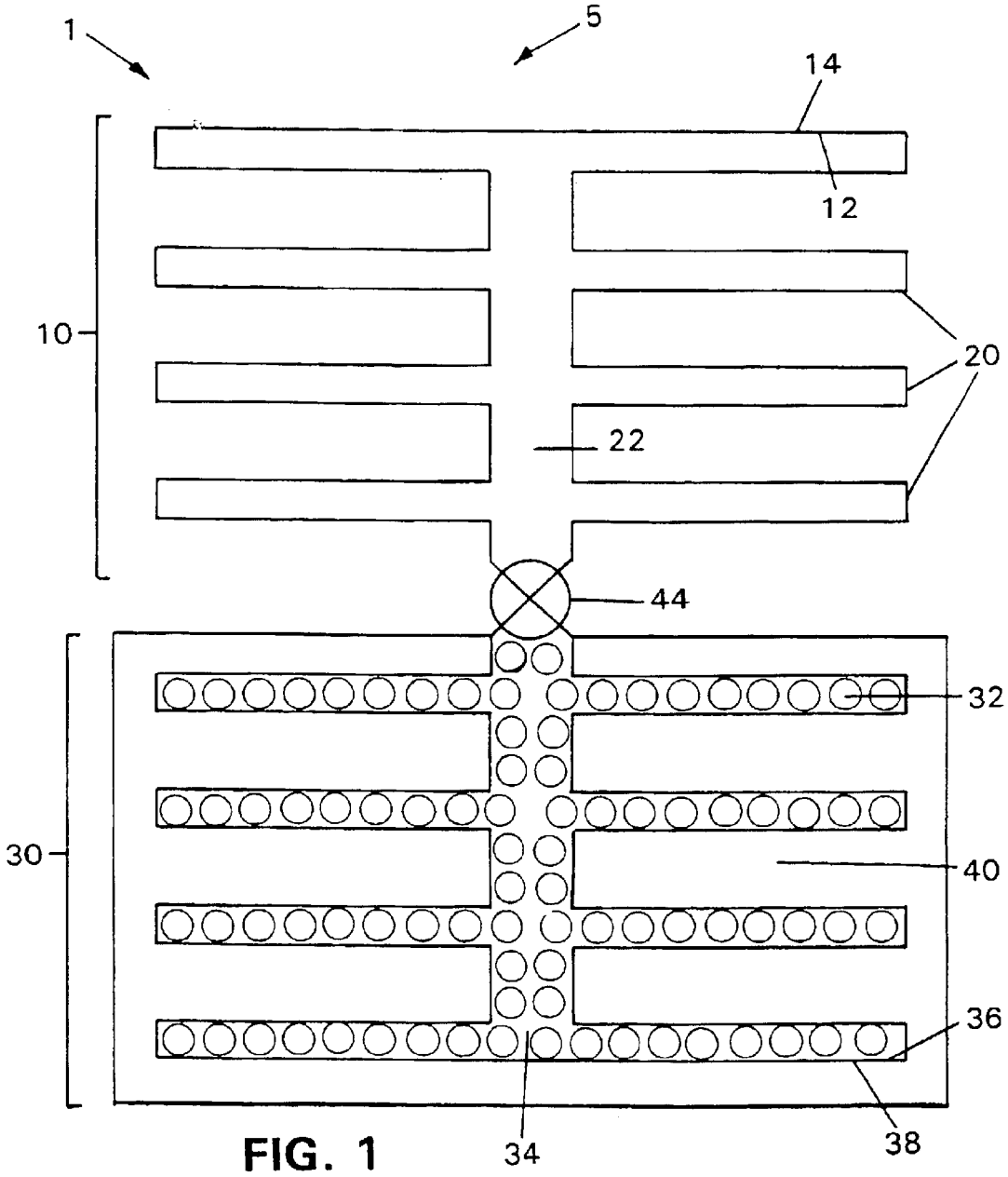
FIG. 1 is a schematic diagram of a refrigeration device useful in certain embodiments of the invention.
Figure 2:
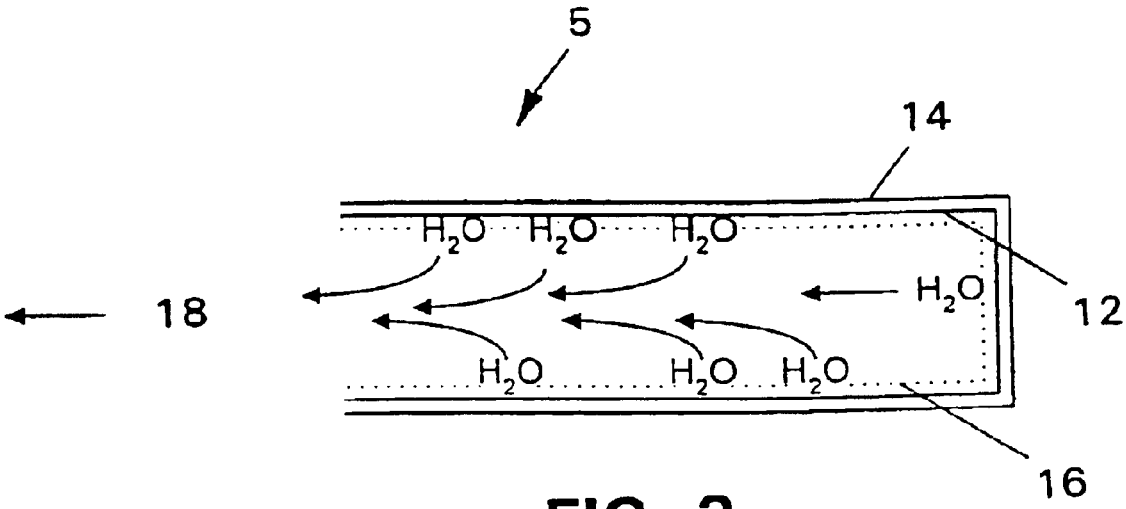
FIG. 2 is a schematic diagram of evaporation and cooling processes occurring at the evaporation chamber during operation of a particular embodiment of the refrigeration device.

Regarding FIG. 1 a particular embodiment of refrigeration device 1 according to the general principles of the invention is displayed. This view shows product 5 which is to be cooled, in contact with evaporator 10, within which evaporation of a refrigerant takes place. Evaporator 10 comprises a chamber within which evaporation of a refrigerant takes place. This generally involves desorption of refrigerant from a surface during the operation of the device. Before the device is activated, the refrigerant is present in the evaporator, both in liquid and vaporous states. In devices such as the present invention, this desorption is driven by a pressure differential which is manifested when a flow-preventing means 44 is operated. Thus, activation of the device amounts to allowing refrigerant vapor flow. As desorption takes place from inner surface 12 of evaporator chamber 10, the outer surface 14 becomes cold. This in turn is able to cool product 5 in thermal contact with outer evaporator surface 14. This in turn is able to cool product 5 in thermal contact with outer evaporator surface 14. This is represented in FIG. 2, showing the desorption of refrigerant ($H_2O$) proceeding in direction 18 leading toward lower pressure. This lower pressure is exposed to the refrigerant upon operation of the refrigeration device, as explained herein.

A wide variety of refrigerants are operative in the device. The general requirements are that the refrigerants be vaporizable and condensable at pressures which can be relatively easily attained in chambers. The refrigerant must also be compatible with the sorbent, that is, it must be capable of being absorbed or adsorbed by the sorbent. Suitable choices for refrigerants must also be those which are able to produce a useful change in temperature in a short time, meet government safety standards, and be relatively compace. The refrigerants used in the devices of the present invention preferably have a high vapor pressure at ambient, temperature, so that a reduction of pressure will result in a high vapor production rate. The vapor pressure of the refrigerant at 20° C. is preferably at least about 9 mmHg. Moreover, for some applications (such as cooling of food products), the refrigerant should conform to applicable government standards in case any discharge into the surroundings, accidental or otherwise, occurs. Refrigerants with suitable characteristics for various uses of the invention include: various alcohols, such as methyl alcohol and ethyl alcohol; ketones or aldehydes, such as acetone and acetaldehyde: ammonia; water, short chain hydrocarbons and short chain halo-hydrocarbons; and freons, such as freon C318, 114, 21, 11, 114B2, 113 and 112. A preferred refrigerant is water.

In addition, the refrigerant may be mixed with an effective quantity of a miscible nucleating agent having a greater vapor pressure than the refrigerant to promote ebullition so that the refrigerant evaporates even more quickly and smoothly, and so that supercooling of the refrigerant does not occur. Suitable nucleating agents include ethyl alcohol, acetone, methyl alcohol, propyl alcohol and isobutyl alcohol, all of which are miscible with water. For example, a combination of a nucleating agent with a compatible refrigerant might he a combination of 5% ethyl alcohol in water. The nucleating agent preferably has a vapor pressure it 25° C. of at least about 25 mm Hg. Alternatively, solid nucleating agents may be used, such as the conventional boiling stones used in chemical laboratory applications.

The desorption processes taking place in the evaporator chamber are most efficiently carried out if the layer of refrigerant is as thin as possible, to the limit of a monolayer of refrigerant spread over as much of the inner desorption chamber surface as possible. These thin films maximize the area for surface evaporation. Multiple layers of refrigerant cause heat transfer through layered refrigerant molecules to a refrigerant molecule which is disposed at the innermost surface of the evaporator. This type of refrigerant overloading results in a temperature difference across the refrigerant layer that is larger than would exist if the layer were thinner. Thus, overloading decreases heat conduction, reducing the efficiency of evaporation. In preferred embodiments with thin layers of refrigerant, the layer thickness is reduced as the refrigeration device operates, decreasing the temperature difference across the layer, improving heat conduction processes as the refrigerator operates. If a refrigerant dispersant is employed, this is also desirably layered as thinly as possible across as much of the internal evaporator chamber surface as possible.

FIG. 2 shows the desorption of refrigerant ($H_2O$) proceeding in direction 18 heading toward lower pressure. This lower pressure is exposed to the refrigerant upon operation of the refrigeration device, as explained herein. The particular embodiment illustrated in FIG. 2 uses water as the refrigerant, but the principles discussed will be applicable to vaporizable refrigerants in general.

The refrigeration devices according to the invention contain a fixed amount of non-circulating refrigerant. If the amount of product to be cooled and the amount of cooling desired are known, the amount of heat to be removed is easily calculated. The amount of heat to be removed specifies precisely the amount of refrigerant which must be evaporated from the evaporator chamber. For example, if 8 fluid ounces (236 mL) of an aqueous liquid is to be cooled by 22° C., about 8.9 grams of water refrigerant is needed as a theoretical minimum. If heat leaks back into the system, more refrigerant will be required.

As mentioned above, the refrigerant desirably forms a layer on inner surface 12 of evaporator 10. This layer of refrigerant is preferably substantially evenly distributed over as much of surface 12 as possible. In certain embodiments of the invention, such as the one shown in FIG. 2, this will be accomplished with the aid of refrigerant dispersant 16, which is preferably deposited in a layer on inner evaporator chamber surface 12, and covers as much of this surface as possible. The layer of dispersant is adapted to allow refrigerant to be absorbed into and/or adsorbed onto it. A variety of materials are available as refrigerant dispersants, as detailed in U.S. Patent Application Ser. No. PCT/US00/04639 (publication number WO 00/50824) entitled "Dispersion of Refrigerant Materials", filed contemporaneously herewith, and incorporated by reference in its entirety. In such an arrangement, heat flows from the product across the wall of the evaporator chamber, across a layer of refrigerant dispersant, and then vaporizes the surface refrigerant molecules from the dispersant.

In selecting the refrigerant dispersant, any of a number of materials may be chosen, depending upon the requirements of the system and the particular refrigerant liquid being used. The refrigerant dispersant may be something as simple as cloth or fabric having an affinity for the refrigerant and a substantial wicking ability. Thus, for example, when the refrigerant is water, the refrigerant dispersant may be cloth, sheets, felt or flocking material which may be comprised of cotton, filter material, natural cellulose, regenerated cellulose, cellulose derivatives, blotting paper or any other suitable material.

The most preferred refrigerant dispersant would be highly hydrophilic such as gel-forming polymers which would be capable of coating the interior surface of the evaporation chamber. Such materials preferably consist of alkyl, aryl and amino derivative polymers of vinyl-chloride acetate, vinylidene chloride, tetrafluoroethylene, methyl methacrylate, hexaneodic acid, dihydro-2.5-furandione, propenoic acid, 1.3-isobenzofurandione, 1 h-pyrrole-2.5-dione or hexahydro-2-h-azepin-2-one.

The refrigerant dispersant may be sprayed, flocked, or otherwise coated or applied onto the interior surface of the evaporator chamber. In a particular embodiment, the refrigerant dispersant is electrostatically deposited onto that surface. In another embodiment, the refrigerant dispersant is mixed with a suitable solvent, such as a non-aqueous solvent, and then the solution is applied to the interior surface of the first chamber.

Figure 3:
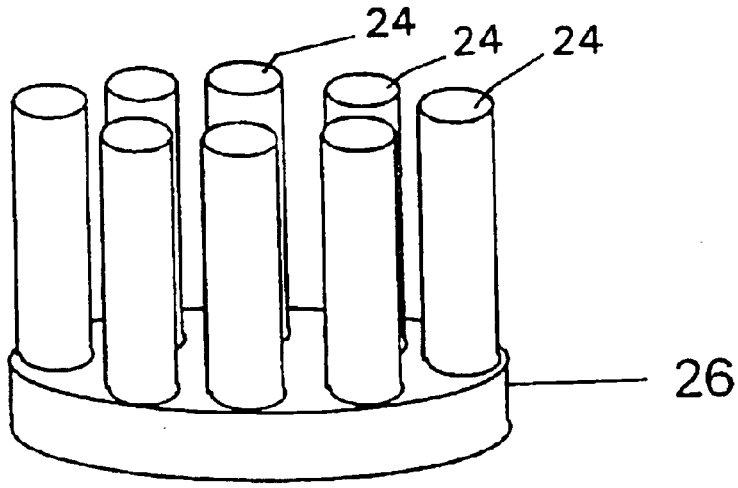
FIG. 3 is a perspective view of a circular arrangement of evaporator fingers which can be used in particular embodiments of the invention.
Figure 4:
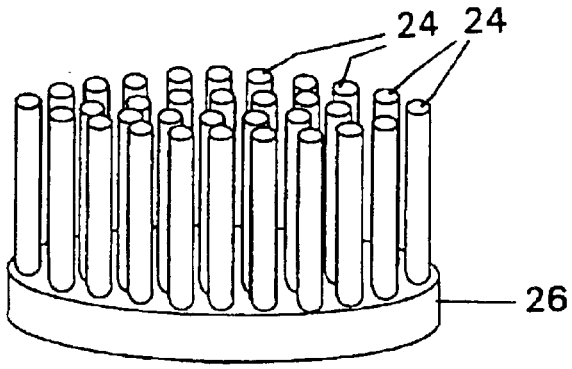
FIG. 4 is a perspective view of a concentric circular arrangement of evaporator fingers which can be used in particular embodiments of the invention.
Figure 5:
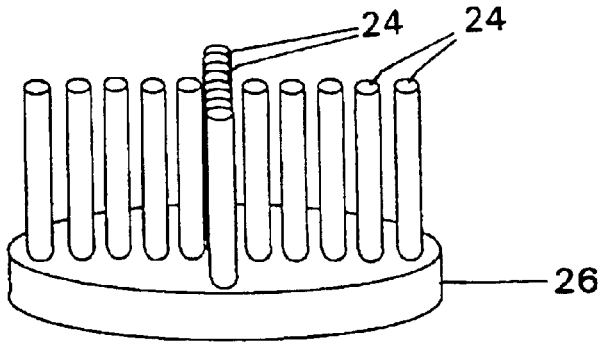
FIG. 5 is a perspective view of a cruciform arrangement of evaporator fingers which can be used in particular embodiments of the invention.

In another preferred embodiment, the refrigerant dispersant is able to control any violent boiling in the evaporator and thus reduces any liquid entrainment in the vapor phase. In such an embodiment, the refrigerant dispersant is a polymer forming a porous space-filing or sponge-hike structure, and it may fill all or part of the evaporator chamber. In the particular embodiment shown in FIG. 1, evaporator 10 has fins 20 and a central passage 22, although a wide variety of shapes and configurations of the evaporator are possible. If fins are used, they can be of a large variety of configurations, and the central passage may be omitted or substantially shortened. In other embodiments, evaporator 10 takes the form of a number of hollow finger-like elements (fingers 24) which do not branch from a central passage as do fins 20, but pass into finger base 26 shown in FIGS. 4–6. Base 26 can contain short passages (not shown) to connect the interior of hollow fingers 24 together to form a short central passage. Alternatively, base 26 can be substantially hollow with a central outlet leading to the means for preventing/allowing vapor flow to the sorbent chamber. Fingers 24 can be arranged in a circle (eight fingers are shown in this arrangement in FIG. 3. but any number could be so arranged), a number of concentric circles (shown in FIG. 4), in a cruciform arrangement (shown in FIG. 5), or a more random arrangement. The general aim is to provide for efficient heat transfer from the bulk medium to inner evaporator 12 by maximizing the area of this surface. The evaporator is desirably also reasonably simple to manufacture and assemble. Additionally, refrigerant vapor flow paths inside the evaporator chamber are desirably adequate to prevent excessive pressure drops in the low density vapor flows.

Normally boiling processes (ebullition), which are initiated by streams of tiny bubbles rising from discrete and easily visible spots on surfaces, require nucleation sites consisting of reentrant cavities containing non-condensable gases such as air. The evaporator chamber in refrigerators according to the present invention is subjected to partial evacuation, effectively removing nucleation sites from the internal surfaces of the evaporator chamber, and degasses the refrigerant as well. Thus, refrigerant molecules subjected to the evacuator chamber preparation methods (as detailed in U.S. Patent Application Ser. No. PCT/US00/04639 (publication number WO 00/50824), entitled "Dispersion of Refrigerant Materials", filed contemporaneously herewith, and incorporated by reference in its entirety), which can also be used in refrigeration devices of the present invention, when exposed to the reduced pressure present in a properly prepared sorbent chamber (as discussed below) evaporate from the surface of a quiescent pool of refrigerant. Heat transfer in such a pool is subject to the same limitations of conduction and convection as in bulk fluids.

The desorption processes taking place in the evaporator chamber are most efficiently carried out if the layer of refrigerant is as thin as possible, to the limit of a monolayer of refrigerant spread over as much of the inner desorption chamber surface as possible. These thin films maximize the area for surface evaporations. Multiple layers of refrigerant cause heat transfer through layered refrigerant molecules to a refrigerant molecule which is disposed at the innermost surface of the evaporator. This type of refrigerant overloading results in a temperature difference across the refrigerant layer that is larger than would exist if the layer were thinner. Thus, overloading decreases heat conduction, reducing the efficiency of evaporation. In preferred embodiments with thin layers of refrigerant, the layer thickness is reduced as the refrigeration device operates, decreasing the temperature difference across the layer, improving heat conduction processes as the refrigerator operates. If a refrigerant dispersant is employed, this is also desirably layered as thinly as possible across as much of the internal evaporator chamber surface as possible.

The refrigerant vapor pressure within the evaporator chamber at the beginning and end of the cooling process can be determined from the equilibrium vapor pressure-temperature function for water, based on the expected beverage temperatures and temperature differences required for heat transfer.

It is desirable to carry out an evacuation of the refrigerant-loaded evaporator chamber prior to assembly. The evacuation should be limited to pressures above or equal to the vapor pressure of water at the temperature at which the evacuation is carried out. For example, at room temperature with water as the refrigerant, the evacuation of the refrigerant-loaded evaporator should be carried out to pressures of about 20 Torr. This evacuation serves to sweep contaminants such as air, wash solvents and the like from the evaporator chamber.

Returning to FIG. 1, there is also shown sorber 30. This section of the refrigeration device includes sorbent 32, which is disposed throughout the interior of sorbent chamber 34. Also included in sorber 30 is heat sink 40. Refrigerant vapor which is formed upon operation of the refrigeration device moves from the evaporator chamber into sorbent chamber 34, carrying heat. This heat is deposited into finite capacity sorbent 32 and further deposited into finite capacity heat sink 40.

The sorbent receives heat not only from the latent heat of vaporization resulting from condensation of the refrigerant vapor, but also from the chemical reaction heat released when refrigerant is combined with the sorbent. Sorbent 32 is in thermal contact with heat sink 40, via internal surface 36 and external surface 38 of sorbent chamber 34. This thermal contact desirably results in highly efficient heat transfer from sorbent 32 to heat sink 40. This heat must be stored in the heat sink in such a manner that it does not leak back into the product during the time that cold product is required.

Materials which are suitable as sorbents are those which have aggressive refrigerant vapor-binding properties, low chemical reaction heats, and are not explosive, flammable or toxic.

The sorbent material used in the sorber is preferably capable of absorbing and adsorbing all the vapor produced by the liquid, and also preferably will meet government safety standards for use in an environment where contact with food may occur. Suitable sorbents for various applications may include barium oxide, magnesium perchlorate, calcium sulfate, calcium oxide, activated carbon, calcium chloride, glycerin, silica gel, alumina gel calcium hydride, phosphoric acid, potassium hydroxide, sulphuric acid, lithium chloride, ethylene glycol and sodium sulfate. These materials can be available in a variety of forms, including flakes, powders, granules, as well as supported on inert shapes or bound with clays. It is desirable that the material have sufficient vapor flow passages through it that refrigeration performance is not limited by the passage of refrigerant vapor through the sorbent. Additionally, the sorbent must be able to transfer heat to tile heat sink material, and thus be in good thermal contact with tile inner surface of the sorbent chamber. Preferred sorbents for use in the present refrigeration device include flaked sorbent or clay-supported sorbent. The latter is available in a wide variety of shapes, including spheres, chips, and rectangular solids.

Among the preferred sorbents for use in the present invention are zeolites, including those known as molecular sieve zeolites. These are crystalline aluminosilicates of sodium, potassium, magnesium and calcium. Thee following formula is generally representative of such species:

$$M_{2/n}[(AlO_2)x(SiO_2]\cdot wH_2O$$

where y is 2 or greater, n is the valence of the cation (sodium, potassium, magnesium or calcium), and w represents the number of water molecules contained in the voids of the zeolite. The ratio y/x usually has a ratio of 1–5, but values can reach up to about 10–100 or higher for silica rich zeolites.

Structurally, zeolites are based on virtually infinite frameworks of tetrahedra of $AlO_4$ and $SiO_4$, in which oxygen atoms are shared. This structure contains channels, or voids which contain cautions and water molecules. The water can be removed reversibly, leaving a crystalline structure which can be about 50% micropores by volume. In some zeolites complete removal of water can perturb the framework structure somewhat and can result in cation displacement, but for the applications discussed herein, this is not generally believed to be critical. An important consideration is whether any perturbation would result which would severely compromise the ability of the zeolite to receive refrigerant vapor. Such perturbations cannot generally be tolerated. The preparation methods described herein do not result in any severe compromise in the ability of the sorbent to receive refrigerant vapor.

Zeolite materials are found in many places on and beneath the surface of the Earth, including basaltic and volcanic rock cavities, as well as fine grained sedimentary rocks. There are a large number of zeolite minerals available, and some of the more common naturally occurring are chabazite ($Ca_2[(AlO_2)_4(SiO_2)_8]\cdot 13\ H_2O$), mordenite ($Na_8[(AlO_2)_8(SiO_2)_{40}\cdot 24\ H_2O$), erionite ($(Ca, Mg, Na_2, K_2)_{4.5}[(AlO_2)_9(SiO_2)\cdot 27\ H_2O$), faujasite ($(Ca, Mg, Na_2, K_2)_{29.5}[(AlO_2)_{59}(SiO_2)_{133}\cdot 235\ H_2O$), and clinoptilolite ($Na_6[(AlO_2)_6(SiO_2)_{30}]\cdot 24\ H_2O$).

Synthetic zeolite materials comprising metallic alumino silicates can be used in the present refrigeration devices. Some of the more common are zeolite A ($Na_{12}[(AlO_2)_{12}(SiO_2)_{12}\cdot 27\ H_2O$), zeolite X ($Na_{86}(AlO_2)_{86}(SiO_2)_{106}]\cdot 264\ H_2O$), zeolite Y ($Na_{56}[(AlO_2)_{56}(SiO_2)_{136}]\cdot 250\ H_2O$), zeolite L ($K_9[(AlO_2)_9(SiO_2)_{27}.22\ H_2O$), zeolite omega ($Na_{6.8}TMA_{1.6}[(AlO_2)s(SiO_2)_{28}]\cdot 21\ H_2O$, where TMA is Tetramethylammonium), and ZSM-5 ($(Na, TPA)_3[(AlO_2)_3(SiO_2)_{93}]\cdot 16\ H_2O$, where TPA is tetrapropylammonium).

Zeolites can be manufactured by three generally classified methods: by the preparation of zeolites from reactive aluminosilicate gels or hydrogels; by the conversion of clay minerals into high purity powders or preformed pellets; and by the use of other naturally occurring raw materials. Zeolites can be produced according to clay-conversion processes to include a water absorbing or adsorbing zeolite as a major or minor component in a gel matrix, a clay matrix or a clay-derived matrix. Powdered products can be bonded together into agglomerated particles with inorganic oxides or minerals. The raw material for clay conversion processes is kaolin, which is typically hydroxylated to meta-kaolin at temperatures of approximately 500–600° C., and at higher temperatures (above 1000° C. or so), mullite and cristobalite are formed. These are converted to zeolites according to further synthetic techniques. Those of skill in the art will be able to carry out such conversions, utilizing techniques readily apparent to those of such skill.

Among preferred sorbents are those with pore sizes which are as large as at least about 7Å would be useful. Some useful sorbents include zeolite 13X.

Such materials must be heated to drive absorbed and adsorbed water from them. Gas molecules tend to adhere to surfaces. Sorbent materials can have porous structures with a very large surface area per unit volume. The volume of non-condensable materials becomes significant in systems requiring final pressures below 220 to 500 milliTorr. As an example, a container filled with molecular sieve (a typical sorbent) can be evacuated at room temperature to a pressure of from about 1 to 5 milliTorr day after day, but will rise in pressure over a few hours to as much as 500 milliTorr between serial evacuations. This rise is attributable to the gradual desorption of sorbed gas molecules. It is unlikely that an economical high production rate refrigeration device could incorporate such a process in its manufacture. Since the sorption process in the sorbent acts as a pump to draw vapor from the evaporator during operation of the device, the refrigerant vapor pressure over the sorbent must at all times be well below the equilibrium saturation pressure of refrigerant in the evaporator. Essential to the usefulness of sorbents in the refrigeration devices discussed herein is the removal of non-condensable gases from the refrigeration system. The presence of non-condensable gases must be avoided anywhere in the system, for such gases are carried by the flowing refrigerant vapor into the sorbent, or could be already present in the sorbent. The presence of non-condensable gases forms a barrier through which refrigerant vapor must diffuse before it can condense. If such gases are present, the refrigeration device will operate at a rate which is limited by the diffusion barrier.

In a similar way, the sorbent must be made as free of condensable gases as possible before the device is operated. The volume of the sorbent is desirably minimized for some preferred embodiments of the invention. Thus, competition between refrigerant and a condensable gas already present in the sorbent will also limit the operation of the refrigeration device to levels below optimum performance.

The present invention provides methods for the preparation of sorbents for use in evaporation/condensation-type refrigerators. The methods generally involve heating and evacuation to remove non-inet gases, including both non-condensable gases and condensable gases. The methods also involve the replacement of non-condensable gases and other contaminants with a gas which can be easily removed before final assembly of the refrigeration device. Gases with high kinetic energies are considerably easier to remove from sorbent materials than are those gases which do not have high kinetic energies. Among preferred gases are those with high ratios of specific heats. This ratio is measured as the ratio of translational energy divided by the sum of rotational and vibrational kinetic energy, at a given temperature. This value is generally the highest for the monoatomic gases such as helium, neon, argon, krypton, xenon. The value for these gases reaches the theoretical maximum value of 1.67. This value is lower for diatomic molecular gases such as oxygen and nitrogen, and is 1.4. This value goes even lower for larger gases with more degrees of freedom. Preferred gases are those with ratios of specific heat of more than about 1.5. Especially preferred are those gases with ratios of specific heat of more than about 1.6.

According to the sorbent preparation methods of the invention, sorbent is heated to at least 250° C., preferably at least 320° C., and most preferably to at least 380° C. This heating can be carried out according to any of a number of methods, the most common being a conventional convection oven designed to operate at the relatively high temperatures required by the methods of the invention. A vacuum oven can also be used, as well as a vacuum "bomb", which is externally heated, with for example, cartridge heaters welded to its surface.

The sorbent material is also subjected to low pressures, desirably simultaneously with the heating step described above. The methods of the invention utilize pressures not higher than about 15 milliTorr, preferably not higher than about 10 milliTorr, and most preferably not higher than about 5 milliTorr. This evactuation can be carried out according to any of a number of methods, the most common being a conventional vacuum pump designed to produce the relatively low pressures required by the methods of the invention. More sophisticated pumps such as diffusion pumps could also be employed in such evacuations.

The combination of heating and evacuation will suffice to remove the vast majority of absorbed and adsorbed material. Such material includes water, oxygen, hydrogen, nitrogen, greases and the like. Although not wishing to be bound by any particular theory as to the mechanisms underlying the operation of the invention, it is believed that water is typically the most aggressively adsorbed/absorbed material on sorbent surfaces. The heating and evacuation of sorbent has the aim of removing substantially all water from the sorbent surfaces. The heating and evacuation processes in a conventional oven-vacuum apparatus are show, since they are determined by unenhanced diffusion processes. Several means can be employed to speed these processes. One is to employ stirring, or a rotating dryer equipped for vacuum operation. Another possibility is a continuous flow process.

Subsequent to the heating and evacuation of sorbent, the vessel containing heated and evacuated sorbent can be charged with a backfilling gas. The backfilling gas fill pressure will depend on the pressure at which the subsequent sorbent chamber filling operation is to be carried out. The fill pressure should be at least that of the area immediately surrounding the sorbent chamber, in order that no air or other gases be able to displace the backfilling gas fill. Typically this means that the sorbent-containing vessel is filled to a pressure of about 1 atmosphere. The introduction of backfilling gas can be carried out when the sorbent is at room temperature, but it is desirably introduced while the sorbent is heated, preferably while it is still heated from the preceding process step. Thus, the evacuated sorbent can be charged with a backfilling gas while the sorbent is at a temperature of from at least about room temperature to about 375° C., and preferably from at least about 90° C. to about 310° C. If the sorbent is to be loaded into the sorber under a vacuum, no backfilling gas need be used, but the vacuum must be sufficiently good that the finally sealed sorber not contain a pressure of higher than about 15 milliTorr.

At this point, the backfilling gas-charged sorbent can either be stored in a gas-tight container for loading into a sorbent chamber at a later time, or loaded directly into a sorbent chamber, preferably while still heated to a temperature of from at least about room temperature to about 375° C. or preferably to a temperature of at least about 90° C. to about 310° C. If the backfilling gas-charged sorbent is stored in a gas-tight container for future use in a sorbent chamber, this container will be evacuated at a later time, preferably immediately before loading into the sorbent container. If the backfilling gas-charged sorbent is to be loaded into an absorber chamber immediately, it is most efficient to carry out the loading while the backfilling gas-charged sorbent is hot, preferably while it is still hot from the preceding heating process step.

Whether or not the backfilling gas-charged sorbent is loaded into a sorbent chamber immediately or later, or later after cooling of the sorbent, the loaded sorbent chamber will have to be evacuated to remove the backfilling gas from the sorbent. If the backfilling gas-charged sorbent has been stored, it can be left at ambient temperature for this evacuation. However, it is to be noted that room temperature backfilling gas molecules migrate relatively slowly out of the passages of most porous sorbents, and that an extended evacuation time will be required. Heating of backfilling gas-charged sorbent which has been stored at room temperature could be carried out before or after loading, but if it is to be carried out after loading, care must be taken in the case of refrigerator devices employing melting-type phase change material heat sinks. If such heat sinks are exposed to heat sufficient to melt them, they must be refrozen before they can be used. It ms believed to be a more enemy and time efficient method of loading the sorbent chambers with backfilling gas-charged sorbent to carry out loading with hot sorbent which is still hot from the preceding heating process steps. Thus, the backfilling gas-charged sorbent can be loaded into sorbent chamber of a evaporation/absorption-type refrigerator at a temperature of at least about room temperature to about 375° C., and preferably at a temperature of at least about 90° C. to about 310° C.

The loading can be carried out according to a number of methods, including pouring the sorbent into an evacuated sorbent chamber under a blanket of inert gas. The loading can also be carried out at room temperature.

The sorbent chamber into which the sorbent is to be loaded also includes a heat sink material. The function of the heat sink material is to absorb heat released by the sorbent, and to prevent leakage of this beat back to the product which is to be cooled by the refrigeration device. Thus, it is critical to maximize the thermal contact between the sorbent and the heat sink material. This can be accomplished by ensuring that sorbent is in good physical contact with the inner surface of the sorbent chamber.

The amount of sorbent required to absorb or absorb a given quantity of refrigerant vapor depends on the sorption capability of the sorbent for the refrigerant vapor. This is generally a function of temperature. Within the sorbent temperature range of interest, water absorption ranges from about 10% to about 25% by weight. For an 8 ounce, 22° C. temperature drop system, 45 to 90 grams of sorbent would be required, an amount which also depends on the effectiveness of the heat sink.

These methods can be employed in the preparation of sorbents and sorber chambers for the refrigeration devices described herein, as well as for those disclosed in U.S. Pat. Nos. 5,197,302 and 5,048,301.

The refrigeration device of the present invention also includes a heat sink located in the sorber. The heat sink is in thermal contact with the outer surface of the sorbent chamber, and thus is in thermal contact with the sorbent.

The heat-removing material may be one of three types: (1) a material that undergoes a change of phase when heat is applied; (2) a material that has a heat capacity greater than the sorbent; or (3) a material that undergoes an endothermic reaction when brought in contact with the liquid refrigerant.

Suitable phase change materials for particular applications may be selected from paraffin, naphthalene, sulphur, hydrated calcium chloride, bromocamphor, cetyl alcohol, cyanimede, eleudic acid, lauric acid, hydrated sodium silicate, sodium thiosulfate pentahuydrate, disodium phosphate, hydrated sodium carbonate, hydrated calcium nitrate, Glauber's salt, potassium, sodium and magnesium acetate as well as hydrated derivatives of such materials, including sodium acetate trihydrate, and disodium phosphate dodecahydrate. The phase change materials remove some of the heat from the sorbent material simply through storage of sensible heat. In other words, they heat up as the sorbent heats up, removing heat from the sorbent. However, the most effective function of the phase change material is in the phase change itself. An extremely large quantity of heat can be absorbed by a suitable phase change material in connection with the phase change (i.e., change from a solid phase to a liquid phase, or change from a liquid phase to a vapor phase). There is typically no change in the temperature of the phase change material during the phase change, despite the relatively substantial amount of heat required to effect the change; which heat is absorbed during the change. Phase change materials which change from a solid to a liquid, absorbing from the sorbent their latent heat of fusion, are the most practical in a closed system. However, a phase change material changing from a liquid to a vapor is also feasible. Thus, an environmentally-safe liquid could be provided in a separate container (not shown) in contact with the sorbent material (to absorb heat therefrom but vented in such a way that the boiling phase change material carries heat away from the sorbent material and entirely out of the system.

Another requirement of any of the phase change materials is that they change phase at a temperature greater than the expected ambient temperature of the material to be cooled, but less than the temperature achieved by the sorbent material upon absorbtion of a substantial fraction (i.e. one-third or one-quarter) of the refrigerant liquid. Thus, for example, in most devices according to the present invention which are intended for use in cooling material such as food or beverage, the phase change material could change phase at a temperature above about 30° C., preferably above 35° C., but preferably below about 70° C., and most preferably below 60° C. Of course, in some applications, substantially higher or lower phase change temperatures may be desirable. Indeed, many phase change materials with phase change temperatures as high as 90° C., or 100° C. may be appropriate in certain systems.

Materials that have a heat capacity greater than that of the sorbent simply provide a thermal mass in contact with the sorbent that does not affect the total amount of heat in the system, but reduces the temperature differential between the material being cooled and the sorber, with two results.

When heat is added to a material which does not melt or evaporate as a result of that heat addition, the heat can be sensed by an increase in temperature. By contrast, the material undergoes a phase change, from solid to liquid for example, the material can absorb heat without a sensible temperature change. The heat energy instead goes into the phase change of the material. The hidden heat is referred to as latent heat. Heat sink materials useful in the present refrigeration device are all melting materials, they absorb significant latent heat, and are able to keep the sorbent at a more even temperature. The cooler the sorbent, the more vapor it can condense, so it is the combined volume of heat sink and sorbent that is of direct interest. A low density material and a high density material may, in principle, has equal total heat capacity, but a refrigeration device utilizing the low density material will require more volume. This increased volume can be undesirable in certain critical applications.

The amount of heat sink material required depends on the amount of refrigerant vapor to be absorbed or adsorbed by the sorbent, the chemical reaction heat of the sorbent and refrigerant vapor binding reaction, the specific heat of the heat sink (or specific heat-latent heat combination in a phase-change material), and the chosen final temperature of the sorber. Since most sorbents decrease in refrigerant vapor sorption capability as the temperature increases, there is a ratio of sorbent to heat sink which yields minimum system mass, and which depends on the properties of the chosen pair.

Suitable phase change material and methods for their preparation are detailed in U.S. Patent Application Ser. No. PCT/US00/04637 (publication number WO 00/50827), entitled "Preparation of Heat Sink Materials", filed contemporaneously herewith, and incorporated by reference in its entirety.

The refrigeration device also includes a means for preventing refrigerant vapor flow from the evaporator chamber to the sorbent chamber before operation of the device. Upon activation of this means, which subsequently allows the flow of refrigerant vapor from the evaporator chamber to the sorbent chamber, desorption and cooling of product begins. The means for preventing vapor flow can take the form of any of the various types shown in the prior art. The means can be located at any location between the chamber and the sorber so long as it prevents refrigerant vapor or vapor of any kind from being sorbed by the sorbent. However, if the entire refrigeration device is contained within a pressurized container, a pressure responsive valve can be used which can actuate the device upon the release of the pressure within the container.

The device can be constructed of a variety of materials, with the restriction that certain portions must be able to afford good thermal contact with certain other portions. These portions must be made of a relatively good thermal conductor such as a metal or metallic material. Preferred materials for the evaporator chamber, and somber include metals such as aluminum, copper, tin, steel, and metal alloys such as aluminum alloy. For some applications, corrosion protection will be required on the outer surface of the evaporator. Corrosion protection can include a thin coating of a lacquer specially designed for that purpose. Those of skill in the amt will be able to provide suitable materials. The thickness of such coatings generally does not interfere with thermal transfer, but the choice of corrosion protectant will be dictated by time affect such protectant has on the heat transfer. Portions of the refrigerator which are not crucial to thermal transfer include the means for preventing/allowing refrigerant vapor flow. This portion can be made of a polymeric material, such as a thermoplastic material.

Figure 6:
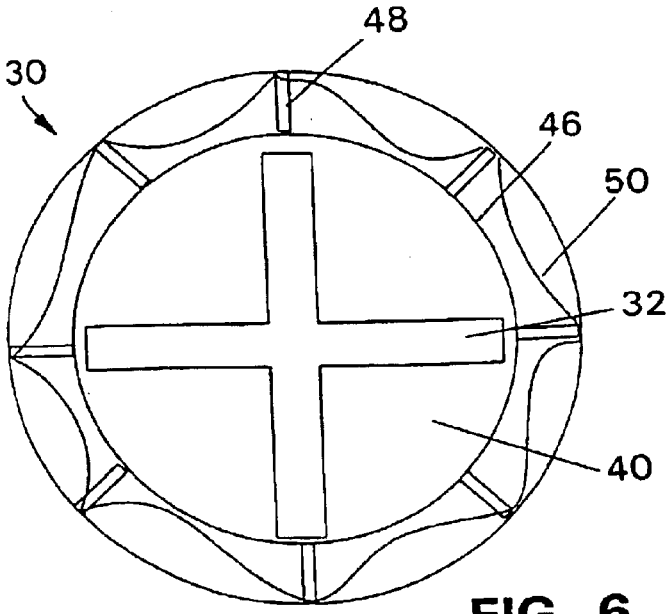
FIG. 6 is an overhead view of a particular embodiment of a refrigeration device according to the invention disposed in a cylindrical product container.

The refrigerators are subjected to external pressure, since they are evacuated internally. In order to avoid the necessity of fabricating a heavy structure, self-supporting arch designs or ribbed designs can be used. Materials with similar gauge to those employed in the construction of carbonated beverage cans are able to find application in the construction of the inventive refrigerators. A particular embodiment of a self-supporting arch design is depicted in FIG. 6. Sorber 30 is shown having sorber 32 and heat sink material 40 included in its interior. On outer surface 46 of sorber 30 are a series of spacers 48. They generally continue around the circumference of surface 46, but some are omitted from FIG. 6 for clarity. There is intermediate material 50, which can be a polymeric material such as a thermoplastic, attached to spacers 48 across the entire circumference of surface 46. The assembly is meant to be placed in a cylindrical product container, with the terminal portions of spacers 48 abutting the inner walls of the cylindrical product container. This assembly assists the sorber to maintain its structure, preventing collapse from pressure inequalities between the interior and exterior of the sorber.

The product which can be cooled can be a liquid, gas or solid, as long as good thermal contact is made with the outer surface of the evaporator. Preferred products to be cooled are liquids or gases, most preferably liquids. Among the liquids which can be cooled using the refrigeration device of the invention are those comprising water, such as those comprising at least 20% water, those comprising at least 40% water, and those comprising at least 60% water. Included among such water-containing liquids are water itself, milk, fruit and vegetable juices, soft-drinks, beer, wine, and mixed drinks. These products can be contained in vessels of various sizes and shapes, and those made of various materials. As mentioned above, certain applications will involve the cooling of liquids which can, over lengthy storage times, corrode the containers in which they are stored. Corrosion protection, known to those skilled in the art, is available in such instances.

The invention also includes a method of using the refrigeration device described herein. The method includes the step of providing a refrigeration device of the type set forth herein, opening the means for preventing vapor flow, whereby the pressure in the evaporator is reduced, causing the refrigerant to be vaporized, which vapor is collected by the sorbent, removing the vapor from the evaporator by collecting the vapor until an equilibrium condition is reached wherein the sorbent is substantially saturated or substantially all the refrigerant originally in the evaporator chamber has been collected in the sorbent, and simultaneously removing heat from the sorbent by means of the heat sink material described above. The process is preferably a one-shot process; thus, opening the means for preventing/allowing flow is preferably irreversible. At the same time, the system is a closed system; in other words, the refrigerant does not escape from the system, and there is no means by which the refrigerant or the sorbent may escape either the evaporator chamber or the sorber.

Other Embodiments

It is to be understood that while the invention has been described in conjunction with the detailed description thereof, the foregoing description is intended to illustrate and not limit the scope of the invention, which is defined by the scope of the appended dams. Other aspects, advantages, and modifications are within the scope of the following claims.

What is claimed is:

1. A method for preparing a sorption chamber for a portable, single-use, non-releasing evaporation-type refrigerator that produces a refrigerant vapor during evaporative heating, the method comprising:

A) providing a sealable chamber for sorbent, and a sorbent material for absorbing and adsorbing the refrigerant vapor;

B) heating said sorbent material to a temperature sufficient to volatilize absorbed and adsorbed material contained therein and thereon;

C) removing said volatilized material from said heated sorbent material by evacuating said sorbent material;

D) adding a backfilling gas to the sorbent, wherein the gas has a ratio of specific heats of at least about 1.5;

E) loading the sorbent chamber with backfilling gas-charged sorbent;

F) removing said backfilling gas from the sorbent by evacuating said sorbent chamber; and G) sealing the sorbent chamber to prevent introduction of air gases to said sorbent.

2. The method of claim 1, wherein the heating of sorbent material is to a temperature of at least about 250° C.

3. The method of claim 2 wherein the heating of sorbent material is to a temperature of at least about 350° C.

4. The method of claim 2, wherein the material volatilized and removed from the sorbent material is water.

5. The method of claim 1, wherein the removal of volatilized material from said sorbent maternal is carried out to a pressure of at most about 15 milliTorr.

6. The method of claim 1, wherein the backfilling gas added to the sorbent has a ratio of specific heats of more than about 1.6.

7. The method of claim 6, wherein the backfilling gas added to the sorbent is selected from the group consisting of helium, neon, argon, krypton and xenon.

8. The method of claim 1, wherein said sorbent material is at a temperature of at least about 100° C. as the backfilling gas is added.

9. The method of claim 5, wherein backfilling gas is added to a pressure of from about 350 Torr to about 2000 Torr.

10. The method of claim 1, wherein the backfilling gas-charged sorbent is loaded into said evacuated absorber temperature at a temperature of from about 25° C. to about 200° C.

11. The method of claim 1, wherein said backfilling gas is removed from said sorbent chamber by re-evacuation of said sorbent chamber to a pressure of less than about 15 milliTorr.

12. The method of claim 1, wherein the sorbent chamber is in thermal contact with a phase change-type heat sink material having a phase transition temperature.

13. The method of claim 1, wherein the re-evacuation of said sorbent chamber is carried out while the sorbent is at a temperature of at least 25° C.

14. The method of claim 1, wherein the sealable chamber for sorbent is provided as flushed and filled with a flushing gas.

15. The method of claim 1, wherein the sealable chamber for sorbent is provided as an evacuated chamber, evacuated to a pressure of not more than about 15 milliTorr.

16. A sorbtion chamber prepared according to the method according to claim 1.

17. A method for preparing a sorption chamber for a portable, single-use, non-releasing evaporation-type refrigerator that produces water vapor during evaporative heating, the method comprising:

A) providing an evacuated sealable chamber, and a zeolite sorbent material for absorbing and adsorbing the water vapor, wherein the chamber is evacuated to a pressure of not more than 10 milliTorr;

B) heating said zeolite sorbent to at least 300° C. to remove absorbed and adsorbed material from the zeolite;

C) removing said volatilized material from said heated sorbent material by evacuating said sorbent material to a pressure of not more than 10 milliTorr;

D) adding helium gas to the zeolite sorbent to a pressure of about 1 atmosphere;

E) loading the sorbent chamber with helium-charged zeolite sorbent;

F) removing said helium from the zeolite sorbent by evacuating said sorbent chamber to a pressure of not more than about 10 milliTorr; and G) sealing the sorbent chamber to prevent introduction of air gases to said zeolite sorbent.

18. A method of cooling a product with a portable, single-use, non-releasing evaporation-type refrigerator that produces refrigerant vapor during evaporative heating, the method comprising:

A) providing a portable, single-use, non-releasing evaporation-type refrigerator comprising:

1) an evaporator chamber in thermal contact with a product to be cooled, wherein the evaporator chamber comprises a refrigerant, dispersed in intimate contact with a refrigerant dispersant, and evacuated to a pressure of not more than about 20 Torr:

2) an evacuated sorber in thermal contact with a phase change-type heat sink material, wherein the sorber comprises a sorbent which is substantially evacuated, wherein the pressure above the sorbent is not more than about 15 milliTorr;

3) a means for preventing refrigerant vapor flow between the evaporator chamber and the sorber, until operation of the device;

B) operating the means for preventing refrigerant vapor flow, thereby permitting said flow, whereby the pressure in the evaporator chamber is reduced, causing the refrigerant to vaporize and form a refrigerant vapor, the vapor collected by the sorbent material in the sorber, and heat is generated in the sorbent;

C) removing the vapor from the evaporator chamber by collecting the vapor until an equilibrium is reached, wherein the sorbent is substantially saturated or substantially all the refrigerant has been collected in the sorbent material; and D) containing the heat generated in the sorbent within the sorber by means of the phase change-type heat sink material.

19. A method for preparing a sorption chamber suitable for use in a portable, single-use, non-releasing evaporation-type refrigerator that produces a refrigerant vapor during evaporative heating, the method comprising:

A) providing a sealable chamber for sorbent, and a sorbent material for absorbing and adsorbing the refrigerant vapor;

B) heating said sorbent material to a temperature sufficient to volatilize absorbed and adsorbed material contained therein and thereon;

C) removing said volatilized material from said heated sorbent material by evacuating said sorbent material;

D) loading the sorbent chamber with evacuated sorbent under a vacuum sufficient to prevent the introduction of air gases to said sorbent; and E) sealing the sorbent chamber containing evacuated sorbent to prevent introduction of air gases to said sorbent.

* * * * *